US011694602B2

(12) United States Patent
Cong et al.

(10) Patent No.: US 11,694,602 B2
(45) Date of Patent: Jul. 4, 2023

(54) PIXEL DRIVE CIRCUIT AND DISPLAY PANEL

(71) Applicant: BOE Technology Group Co., Ltd., Beijing (CN)

(72) Inventors: Ning Cong, Beijing (CN); Ming Yang, Beijing (CN); Han Yue, Beijing (CN); Can Wang, Beijing (CN); Can Zhang, Beijing (CN); Jiao Zhao, Beijing (CN); Minghua Xuan, Beijing (CN); Xiaochuan Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 373 days.

(21) Appl. No.: 17/040,988

(22) PCT Filed: Apr. 27, 2020

(86) PCT No.: PCT/CN2020/087179
§ 371 (c)(1),
(2) Date: Sep. 24, 2020

(87) PCT Pub. No.: WO2020/228524
PCT Pub. Date: Nov. 19, 2020

(65) Prior Publication Data

US 2022/0383800 A1 Dec. 1, 2022

(30) Foreign Application Priority Data

May 15, 2019 (CN) ..... 201910403523.3

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 2300/0819* (2013.01);
(Continued)

(58) Field of Classification Search
CPC ..... G09G 3/32; G09G 3/2007; G09G 2300/0819; G09G 2300/0852; G09G 2300/0861; G09G 2310/061
See application file for complete search history.

(56) References Cited

U.S. PATENT DOCUMENTS

2003/0132927 A1 7/2003 Ouchi et al.
2009/0058843 A1 3/2009 Ishizuka
(Continued)

FOREIGN PATENT DOCUMENTS

CN 101996580 A 3/2011
CN 102262858 A 11/2011
(Continued)

OTHER PUBLICATIONS

International Search Report for PCT/CN2020/087179 dated Jul. 24, 2020.
(Continued)

*Primary Examiner* — Andrew Sasinowski
(74) *Attorney, Agent, or Firm* — Ling Wu; Stephen Yang; Ling and Yang Intellectual Property

(57) ABSTRACT

The present disclosure discloses a pixel drive circuit and a display panel. The pixel drive circuit includes a Micro-LED, a cathode of which is grounded; a light-emitting control circuit connected with an anode of the Micro-LED and configured to control an emission time of the Micro-LED; a current control circuit connected with the light-emitting control circuit and configured to output a preset current to the light-emitting control circuit to control the Micro-LED to work under a set current density, and luminance efficiency of the Micro-LED under the set current density is greater than a set threshold value.

10 Claims, 9 Drawing Sheets

(52) U.S. Cl.
CPC ..... *G09G 2300/0852* (2013.01); *G09G 2300/0861* (2013.01); *G09G 2310/061* (2013.01)

(56) References Cited

U.S. PATENT DOCUMENTS

| | | | | |
|---|---|---|---|---|
| 2009/0219279 | A1 | 9/2009 | Ishii et al. | |
| 2011/0292092 | A1 | 12/2011 | Ozawa | |
| 2015/0034945 | A1 | 2/2015 | Sakakura et al. | |
| 2018/0095502 | A1 | 4/2018 | Yamazaki et al. | |
| 2018/0144674 | A1* | 5/2018 | Gupta | G09G 3/3233 |
| 2018/0182294 | A1 | 6/2018 | Radhakrishnan et al. | |
| 2018/0212096 | A1 | 7/2018 | Liang et al. | |
| 2019/0006452 | A1* | 1/2019 | Cho | H01L 27/1214 |
| 2019/0110344 | A1 | 4/2019 | Lo et al. | |
| 2019/0130838 | A1 | 5/2019 | Miyasaka et al. | |
| 2019/0156749 | A1* | 5/2019 | Wang | G09G 3/3233 |
| 2020/0074933 | A1* | 3/2020 | Ban | G09G 3/3283 |
| 2020/0265786 | A1 | 8/2020 | Li | |
| 2020/0302855 | A1 | 9/2020 | Yue et al. | |

FOREIGN PATENT DOCUMENTS

| | | | |
|---|---|---|---|
| CN | 106229394 | A | 12/2016 |
| CN | 206672609 | U | 11/2017 |
| CN | 107808604 | A | 3/2018 |
| CN | 108470537 | A | 8/2018 |
| CN | 108550344 | A | 9/2018 |
| CN | 208014348 | U | 10/2018 |
| CN | 208045072 | U | 11/2018 |
| CN | 108962106 | A | 12/2018 |
| CN | 109119029 | A | 1/2019 |
| CN | 109166525 | A | 1/2019 |
| CN | 109410840 | A | 3/2019 |
| CN | 109584808 | A | 4/2019 |
| CN | 109616045 | A | 4/2019 |
| CN | 109979378 | A | 7/2019 |
| JP | 2017227755 | A | 12/2017 |

OTHER PUBLICATIONS

Office Action dated Apr. 9, 2020 for Chinese Patent Application No. 201910403523.3 and English Translation.
Decision to Grant dated Sep. 4, 2020 for Chinese Patent Application No. 201910403523.3 and English Translation.

* cited by examiner

PIXEL DRIVE CIRCUIT AND DISPLAY PANEL

CROSS-REFERENCE TO RELATED APPLICATION

The present disclosure claims the priority to Chinese patent application No. 201910403523.3 filed to CNIPA on May 15, 2019, entitled "pixel drive circuit and display panel", the entire content of which is incorporated in the present disclosure by reference.

TECHNICAL FIELD

The present disclosure relates to the field of display technology of Micro-LEDs, in particular to a pixel drive circuit and a display panel.

BACKGROUND

With a continuous development of display technology, people's requirements for resolution, luminance and color saturation of a display panel are constantly increased. The micro light-emitting diode (Micro-LED) is widely used in display panels because of its advantages, such as high luminance, high efficiency, fast reaction time, small size, long life, etc.

However, in the related art, luminance and gray scales of a Micro-LED cannot be accurately and effectively controlled, and working stability of the Micro-LED is poor, thus greatly reducing user experience.

SUMMARY

The present disclosure is intended to solve one of the technical problems in the related art at least to some extent. Therefore, a first objective of the present disclosure is to propose a pixel drive circuit.

A second objective of the present disclosure is to provide a display panel.

In order to achieve the above objectives, an embodiment of a first aspect of the present disclosure proposes a pixel drive circuit, which includes a Micro-LED, a cathode of the Micro-LED is grounded; a light-emitting control circuit connected with an anode of the Micro-LED and configured to control an emission time of the Micro-LED; a current control circuit connected with the light-emitting control circuit and configured to output a preset current to the light-emitting control circuit to control the Micro-LED to work at a set current density and luminous efficiency of the Micro-LED under the set current density is greater than a set threshold.

In addition, the pixel drive circuit according to the above embodiment of the present disclosure may further have the following additional technical features.

According to an embodiment of the present disclosure, the current control circuit includes a first control sub-circuit, herein a first terminal of which is connected with a first power supply terminal, and a second terminal of which is connected with the light emitting control circuit; a first storage sub-circuit connected to a third terminal of the first control sub-circuit for discharging through the first control sub-circuit and controlling the first control sub-circuit to work at the preset current; a first charging circuit connected with the first storage sub-circuit for charging the first storage sub-circuit.

According to an embodiment of the present disclosure, the first control sub-circuit includes a first transistor, herein a first electrode of which is connected with the first power supply terminal, and a second electrode of which is connected with the light-emitting control circuit. The first storage sub-circuit includes a first capacitor, herein a first terminal of which is connected with a control electrode of the first transistor, and a second terminal of which is grounded. The first charging circuit includes a second transistor, herein a first terminal of which is connected with the first terminal of the first capacitor, a second terminal of which is connected with a first data signal terminal, and a control terminal of which is connected with a first scanning signal terminal.

According to an embodiment of the present disclosure, the light emitting control circuit includes a driving transistor, herein a first electrode of which is connected with the current control circuit, and a second electrode of which is connected with the anode of the micro light emitting diode; a second control sub-circuit, herein a first terminal of which is connected with a control electrode of the driving transistor; a first discharge sub-circuit connected with a second terminal of the second control sub-circuit; a second storage sub-circuit connected with a second terminal of the first control sub-circuit, and configured to output a gradually decreased voltage and control the drive transistor to conduct when the voltage is lower than a set threshold; a second charging circuit connected with the second storage sub-circuit for charging the second storage sub-circuit.

According to an embodiment of the present disclosure, the second control sub-circuit includes a third transistor, a first electrode of which is connected with the control electrode of the drive transistor, and a control electrode of which is connected with a second scanning signal terminal. The first discharge sub-circuit includes a fourth transistor, a first electrode of which is connected with a second electrode of the third transistor, and a control electrode of which is connected with the second scanning signal terminal; a first resistor, herein a first terminal of the resistor is connected with a second electrode of the fourth transistor, and a second terminal of the resistor is grounded. The second storage sub-circuit includes a second capacitor, herein a first terminal of the second capacitor is connected with the second terminal of the resistor, and a second terminal of the second capacitor is connected with a second electrode of the third transistor. The second charging sub-circuit includes a fifth transistor, herein a first electrode of the fifth transistor is connected with the second terminal of the second capacitor, a second electrode of the fifth transistor is connected with a second data signal terminal, and a control electrode of the fifth transistor is connected with the first scanning signal terminal.

According to an embodiment of the present disclosure, the pixel drive circuit further includes a reset circuit connected with the anode of the micro light emitting diode for resetting an anode voltage of the micro light emitting diode to a preset initial voltage.

According to an embodiment of the present disclosure, the reset circuit includes a sixth transistor, herein a first electrode of the sixth transistor is connected with the anode of the micro light emitting diode, a second electrode of the sixth transistor is connected with a second power supply terminal, and a control electrode of the sixth transistor is connected with a third scanning signal terminal.

According to an embodiment of the present disclosure, the first transistor, the second transistor, the third transistor, the fourth transistor, the fifth transistor, the sixth transistor and the driving transistor are all P-type transistors.

In order to achieve the above objectives, an embodiment of the second aspect of the present disclosure proposes a display panel, which includes the pixel drive circuit proposed in the embodiments of the first aspect of the disclosure.

DETAILED DESCRIPTION

Figure 1:
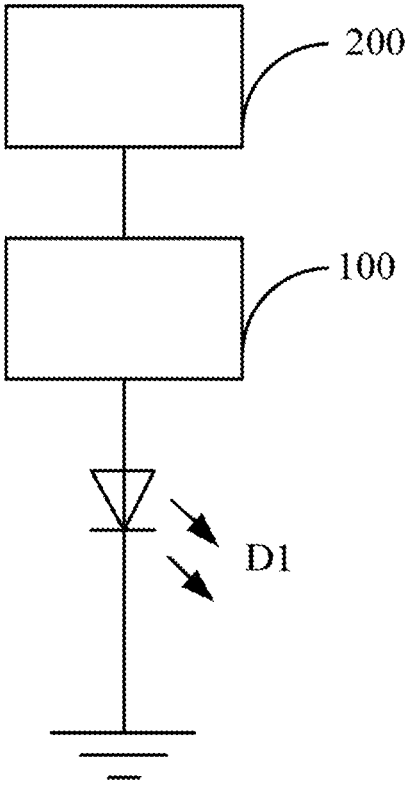
FIG. 1 is a schematic diagram of structure of a pixel drive circuit according to an embodiment of the present disclosure.

Descriptions will now be made in detail to embodiments, examples of which are illustrated in the accompanying drawings. Same or similar elements and elements having same or similar functions are denoted by same or similar reference numerals throughout the descriptions. The embodiments described below with reference to the drawings are illustrative, and are merely intended to explain the present disclosure, which cannot be interpreted as a limitation of the present disclosure.

A pixel drive circuit and a display panel proposed according to an embodiment of the present disclosure will be described below with reference to the drawings.

FIG. 1 is a schematic diagram of structure of a pixel drive circuit according to an embodiment of the present disclosure. As shown in FIG. 1, the pixel drive circuit of the embodiment of the present disclosure may include a Micro-LED D1, a light emitting control circuit 100 and a current control circuit 200.

Herein, a cathode of the Micro-LED D1 is grounded. The light emitting control circuit 100 is connected with an anode of the Micro-LED D1, and is used for controlling a light emission time of the Micro-LED D1. The current control circuit 200 is connected with the light emitting control circuit 100, and is used for outputting a preset current to the light emitting control circuit 100 to control the Micro-LED D1 to work at a set current density, and luminous efficiency of the Micro-LED D1 under the set current density is greater than a set threshold.

Specifically, at present, in a practical working process of a Micro-LED, as luminous efficiency and color coordinates of the Micro-LED will change with the change of a current density, there is still no a mature display drive scheme of the Micro-LED that can accurately and effectively control luminance and gray scale of the Micro-LED, and working stability of the Micro-LED is poor.

Therefore, an embodiment of the present disclosure proposes a pixel drive circuit suitable for a micro light emitting diode. A current control circuit 200 controls a Micro-LED D1 to always work in a high current density region, that is, a stable device efficiency region, thus ensuring luminous efficiency of the Micro-LED D1 and improving working stability of the Micro-LED D1, and a light emitting control circuit 100 controls a light emission time of the Micro-LED D1, thus accurately and effectively controlling luminance and gray scale of the Micro-LED D1

The following describes in detail how to control the Micro-LED D1 to always work in a high current density region through the current control circuit 200 in combination with a specific structure of the current control circuit.

Figure 2:
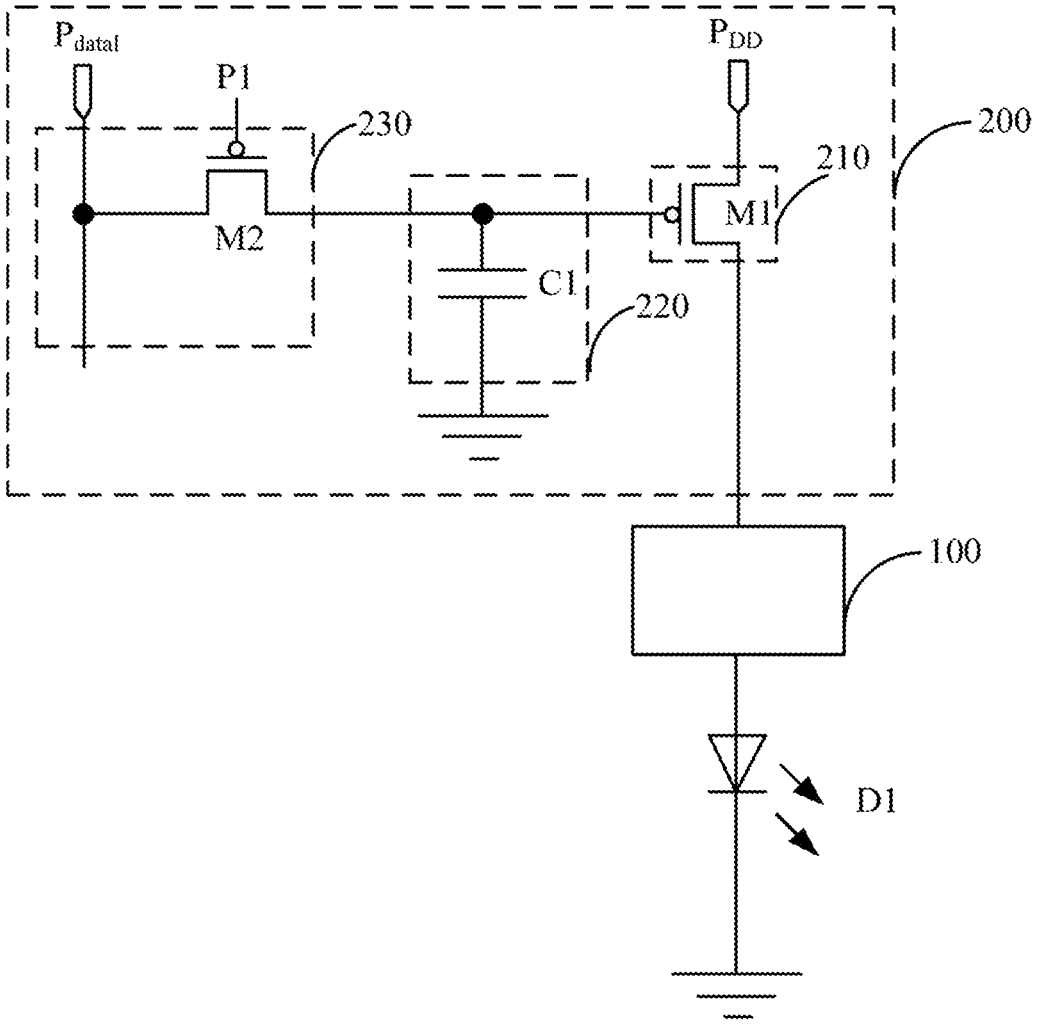
FIG. 2 is a schematic diagram of structure of a pixel drive circuit according to an embodiment of the present disclosure.

According to an embodiment of the present disclosure, as shown in FIG. 2, the current control circuit 200 may include a first control sub-circuit 210, a first storage sub-circuit 220, and a first charging sub-circuit 230. Herein, a first terminal of the first control sub-circuit 210 is connected with a first power supply terminal PDD, and a second terminal of the first control sub-circuit 210 is connected with the light emitting control circuit 100. The first storage sub-circuit 220 is connected with a third terminal of the first control sub-circuit 210, and is used for discharging through the first control sub-circuit 210 and controlling the first control sub-circuit 210 to work at a preset current, for example, the preset current may range from several hundreds of nanoamperes to several tens of microamperes. The first charging sub-circuit 230 is connected with the first storage sub-circuit 220 for charging the first storage sub-circuit 220.

According to an embodiment of the present disclosure, as shown in FIG. 2, in the embodiment, taking a first transistor M1 and a second transistor M2 being enhanced P-type transistors for instance, of course, the first transistor M1 and the second transistor M2 may be N-type transistors. The first control sub-circuit 210 includes the first transistor M1, a first electrode of which is connected with the first power supply terminal PDD, and a second electrode of which is connected with the light emitting control circuit 100, herein the first control sub-circuit 210 operates when the first transistor M1 is turned on. The first storage sub-circuit 220 may include a first capacitor C1, herein a first terminal of the first capacitor C1 is connected with a control electrode of the first transistor M1, and a second terminal of the first capacitor C1 is grounded. The first charging sub-circuit 230 may include a second transistor M2, herein a first electrode of the second transistor M2 is connected with the first terminal of the first capacitor C1, a second electrode of the second transistor M2 is connected with a first data signal terminal $P_{DataI}$, and a control electrode of the second transistor M2 is connected with a first scanning signal terminal P1. Herein, a gate signal (Gate) may be input to the control electrode of the second transistor M2 through the first scanning signal terminal P1.

Specifically, in a process of controlling the Micro-LED D1 by the current control circuit 200, the first capacitor C1 may be charged by the first charging sub-circuit 230 in the current control circuit 200. Specifically, a low-level signal may be input to the control electrode (gate) of the second transistor M2, i.e., the gate signal Gate is set to a low level, so that the second transistor M2 meets a turn-on condition, thereby controlling the second transistor M2 to turn on. At this time, a first data signal DataI with a voltage of $V_{dataI}$ may be input through the first data signal terminal $P_{DataI}$ to charge the first capacitor C1.

Further, after charging is completed, a high-level signal may be input to the gate of the second transistor M2, that is, the gate signal (Gate) is set to a high level to turn off the second transistor M2. At this time, the first storage sub-circuit 220 may discharge to the control electrode (gate) of the first transistor M1 through the first capacitor C1. A gate voltage for driving the first transistor M1 may be controlled by the first capacitor C1, thereby controlling a working state of the first transistor M1 to be in a saturation state, so that the first transistor M1 works at a preset current (i.e., a saturated current within a preset range, for example, between several hundreds of Nano amperes to several tens of Micro amperes). It should be noted that when the type of the first transistor M1 is different, a way to control the working state of the first transistor M1 to be in the saturation state is correspondingly different. For example, when the first transistor is an enhanced N-type field effect transistor, the gate voltage for driving the first transistor M1 may be controlled by the first capacitor C1, so that a voltage between the first electrode (source) and second electrode (drain) of the first transistor M1 is greater than or equal to a difference value between a voltage of the control electrode (gate) and the first electrode (source) and a turn-on voltage, thereby controlling the first transistor to be in a saturation state. When the first transistor M1 is a depletion-type N-type field effect transistor, the gate voltage of the first transistor M1 may be controlled by the first capacitor C1 so that a voltage between the first electrode (source) and second electrode (drain) of the first transistor M1 is greater than or equal to a difference value between a pinch-off voltage and a voltage of the control electrode (gate) and the first electrode (source), thereby controlling the first transistor M1 to be in a saturated state.

Furthermore, the preset current may be input to the Micro-LED D1 through the light emitting control circuit 100, so that the Micro-LED D1 may work at a set current density, thereby controlling the Micro-LED D1 to work in a high EQE (External Quantum Efficiency) region, and further ensuring that luminous efficiency of the Micro-LED D1 is greater than a set threshold value, which may be 3%-30%. Of course, the set threshold value may be other values depending on a specific micro light emitting transistor.

Figure 3:
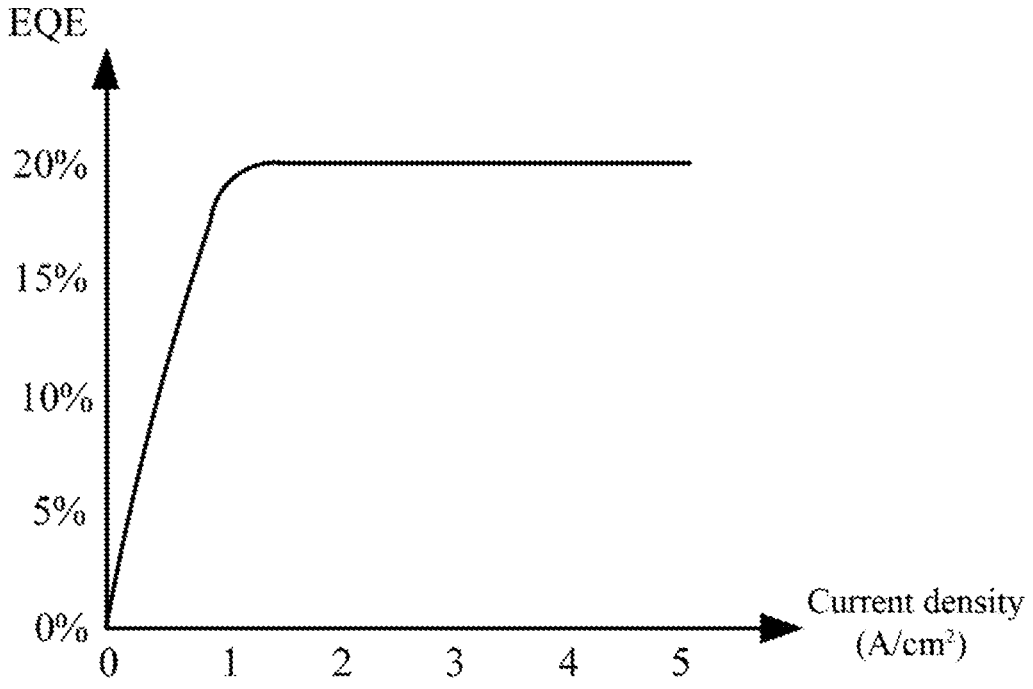
FIG. 3 is a characteristic graph of one of Micro-LEDs according to a specific embodiment of the present disclosure.

Generally, there is a certain relationship between the EQE of the Micro-LED D1 and the current density. When the current density is low, the EQE of the Micro-LED D1 may increase with an increase of the current density. When the current density reaches a certain value, the EQE of the Micro-LED D1 tends to be stable and reaches a maximum value. Herein, corresponding characteristic curves (relationship curves between EQE of Micro-LEDs and current density) of different Micro-LEDs are different. For example, a characteristic curve of a Micro-LED may be shown in FIG. 3. Therefore, in order to make the Micro-LED D1 work in a stable state, in an embodiment of the present disclosure, the first transistor M1 may be controlled to work at the preset current, and the preset current is input to the Micro-LED D1 through the light emitting control circuit 100 to control the Micro-LED D1 to work in the high EQE region (for example, a flat region in FIG. 3), thereby ensuring that luminous efficiency of the Micro-LED D1 is greater than the set threshold value and improving the working stability of the Micro-LED D1.

Furthermore, how to control an emission time of the Micro-LED D1 through the light-emitting control circuit 100 will be explained in detail by combining with a specific structure of the light-emitting control circuit 100.

Figure 4:
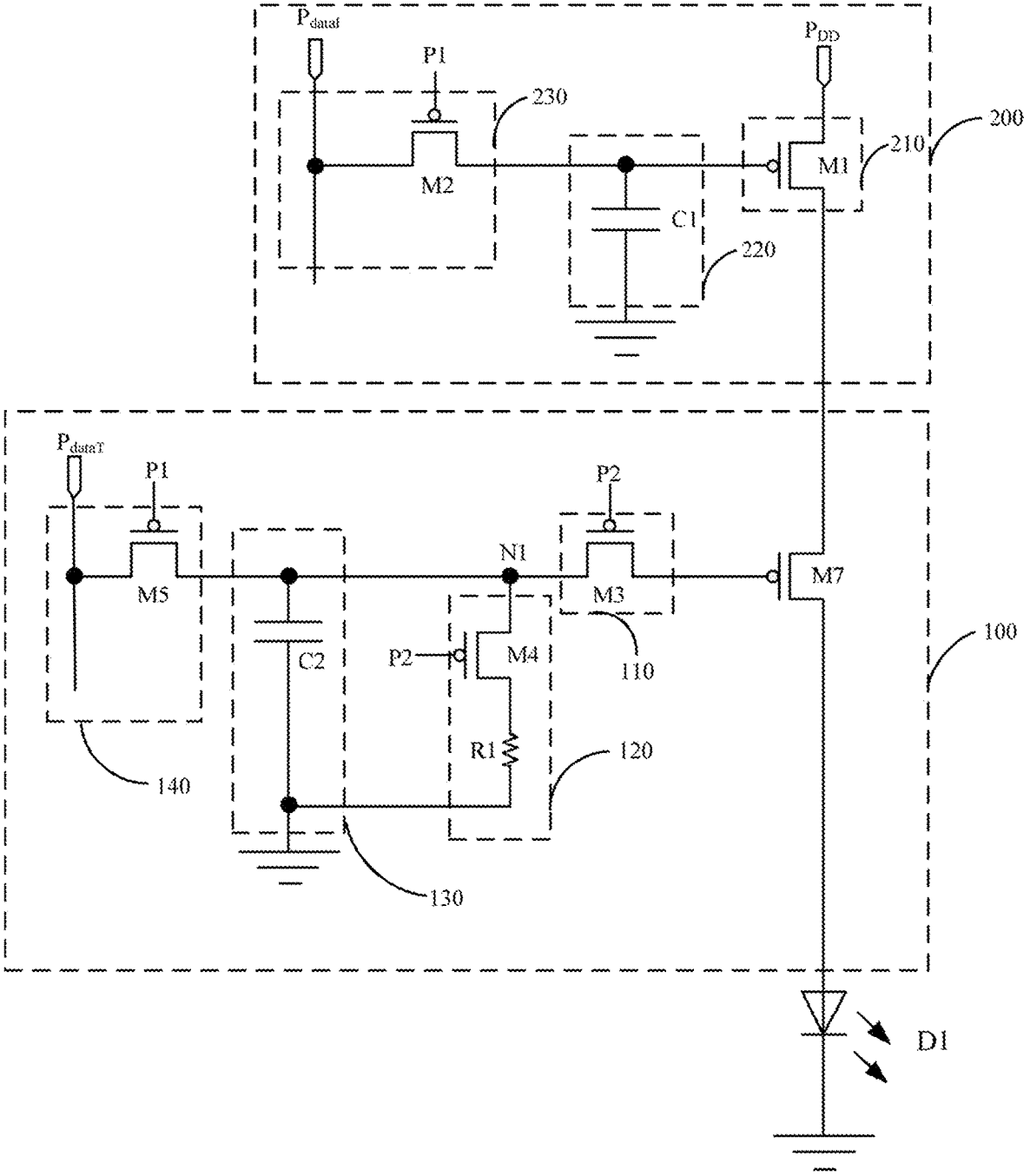
FIG. 4 is a schematic diagram of structure of a pixel drive circuit according to another embodiment of the present disclosure.

According to an embodiment of the present disclosure, as shown in FIG. 4, the light emitting control circuit 100 may include a drive transistor M7, a second control sub-circuit 110, a first discharging sub-circuit 120, a second storage sub-circuit 130 and a second charging circuit 140. Herein, a first electrode of the drive transistor M7 is connected with the current control circuit 200, and a second electrode of the drive transistor M7 is connected with the anode of the Micro-LED D1. A first terminal of the second control sub-circuit 110 is connected with a control electrode of the drive transistor M7. The first discharging circuit 120 is connected with a second terminal of the second control sub-circuit 110. The second storage sub-circuit 130 is connected with the second terminal of the second control sub-circuit 110, and is used for outputting a gradually decreased voltage and controlling the drive transistor M7 to be turned on when the voltage is lower than a set threshold. The second charging sub-circuit 140 is connected with the second storage sub-circuit 130 for charging the second storage sub-circuit 130. In the embodiment, taking the drive transistor M7 as a P-type transistor for example, of course, the drive transistor M7 may be an N-type transistor.

According to an embodiment of the present disclosure, as shown in FIG. 4, the second control sub-circuit 110 may include a third transistor M3, herein a first electrode of the third transistor M3 is connected with the control electrode of the drive transistor M7, and a control electrode of the third transistor M3 is connected with a second scanning signal terminal P2, a light emission signal EM can be input to the control electrode of the third transistor M3 through the second scanning signal terminal P2. The first discharging sub-circuit 120 may include a fourth transistor M4 and a resistor R1, herein a first electrode of the fourth transistor M4 is connected with a second electrode of the third transistor M3, and a control electrode of the fourth transistor M4 is connected with the second scanning signal terminal P2, the light emission signal EM may be input to the control electrode of the fourth transistor M4 through the second scanning signal terminal P2. A first terminal of the resistor R1 is connected with a second electrode of the fourth transistor M4, and a second terminal of the resistor R1 is grounded. The second storage sub-circuit 130 may include a second capacitor C2, herein a first terminal of the second capacitor C2 is connected with the second terminal of the resistor R1, and a second terminal of the second capacitor C2 is connected with the second electrode of the third transistor M3. The second charging sub-circuit 140 may include a fifth transistor M5, herein a first electrode of the fifth transistor M5 is connected with the second terminal of the second capacitor C2, a second electrode of the fifth transistor M5 is connected with a second data signal terminal $P_{DataT}$, and a control electrode of the fifth transistor M5 is connected with a first scanning signal terminal P1, a gate signal Gate may be input to the control electrode of the fifth transistor M5 through the first scanning signal terminal P1.

Specifically, in the embodiment, taking the third transistor M3, the fourth transistor M4 and the fifth transistor M5 as P-type transistors for instance, of course, the third transistor M3, the fourth transistor M4 and the fifth transistor M5 may be N-type transistors. In a process of controlling the Micro-LED D1 through the light emitting control circuit 100, the second capacitor C2 in the second storage sub-unit 130 may be charged by the second charge sub-unit 140 in the light emitting control circuit 100. Specifically, a low-level signal may be input to the control electrode (gate) of the fifth transistor M5, i.e., the gate signal Gate is set to a low level, so that the fifth transistor M5 meets a turn-on condition, thereby controlling the fifth transistor M5 to conduct. At this time, a second data signal DataT with a voltage of $V_{dataT}$ may be input through the second data signal terminal $P_{DataT}$ to charge the second capacitor C2.

Furthermore, after charging is completed, a high-level signal may be input to the control electrode of the fifth transistor M5, i.e., the gate signal Gate is set to a high level to turn off the fifth transistor M5. At this time, a low-level signal may be input to the control electrodes (gates) of the fourth transistor M4 and the third transistor M3, i.e., the light emission signal EM is set to be a low level to turn on the fourth transistor M4 and the third transistor M3, so that electric energy stored in the second capacitor C2 is discharged through the first discharging sub-circuit 120 in which the resistor R1 is located.

Herein, in the process of discharging, there is a certain relationship between the voltage $V_{dataT}$ of the second data signal DataT and a voltage at the node N1, that is, $$V(t) = (V_{dataT} - V_{ff}) * e^{-\frac{t}{R_a C_b}}, \tag{1}$$

Herein, $V_{dataT}$ is the voltage of the second data signal DataT, which may be a high level or a low level, $V_{ff}$ is a smaller voltage value, $R_a$ is a resistance value of the resistor R1, $C_b$ is a capacitance value of the second capacitor C2, t is the current time, and V(t) is the voltage value at the node N1 at the current time.

By processing the above formula (1), a time required for the voltage value at the node N1 to reach a certain voltage can be obtained, that is, $$t = R_a C_b * \ln\left|\frac{V_{dataT} - V_{ff}}{V(t)}\right|. \tag{2}$$

According to the formula (1), the voltage value Vet) at node N1 may be gradually decreased with a change of time. According to the turn-on condition of the drive transistor M7, when the voltage value Vet) at node N1 decreases to a set threshold (i.e., a turn-on voltage V1 of the drive transistor M7), the drive transistor M7 may be turned on. At this time, a preset current output by current control circuit 200 can be input to the Micro-LED D1, so that the Micro-LED D1 starts to emit light until an end of the current frame.

According to an embodiment of the present disclosure, the light emitting control circuit 100 is specifically used for controlling the emission time of the Micro-LED by adopting a pulse width control method.

Specifically, according to the above formulas (1) and (2), when the voltage $V_{dataT}$ of the second data signal DataT changes, a relationship between the voltage value Vet) at the node N1 and time t may change accordingly. Therefore, when the voltage $V_{dataT}$ of the second data signal DataT changes, a changing rate of the voltage value V(t) at the node N1 with time changes correspondingly, and the time when the voltage value V(t) at the node N1 decreases to the turn-on voltage V1 of the drive transistor M7 also changes correspondingly.

Figure 5:
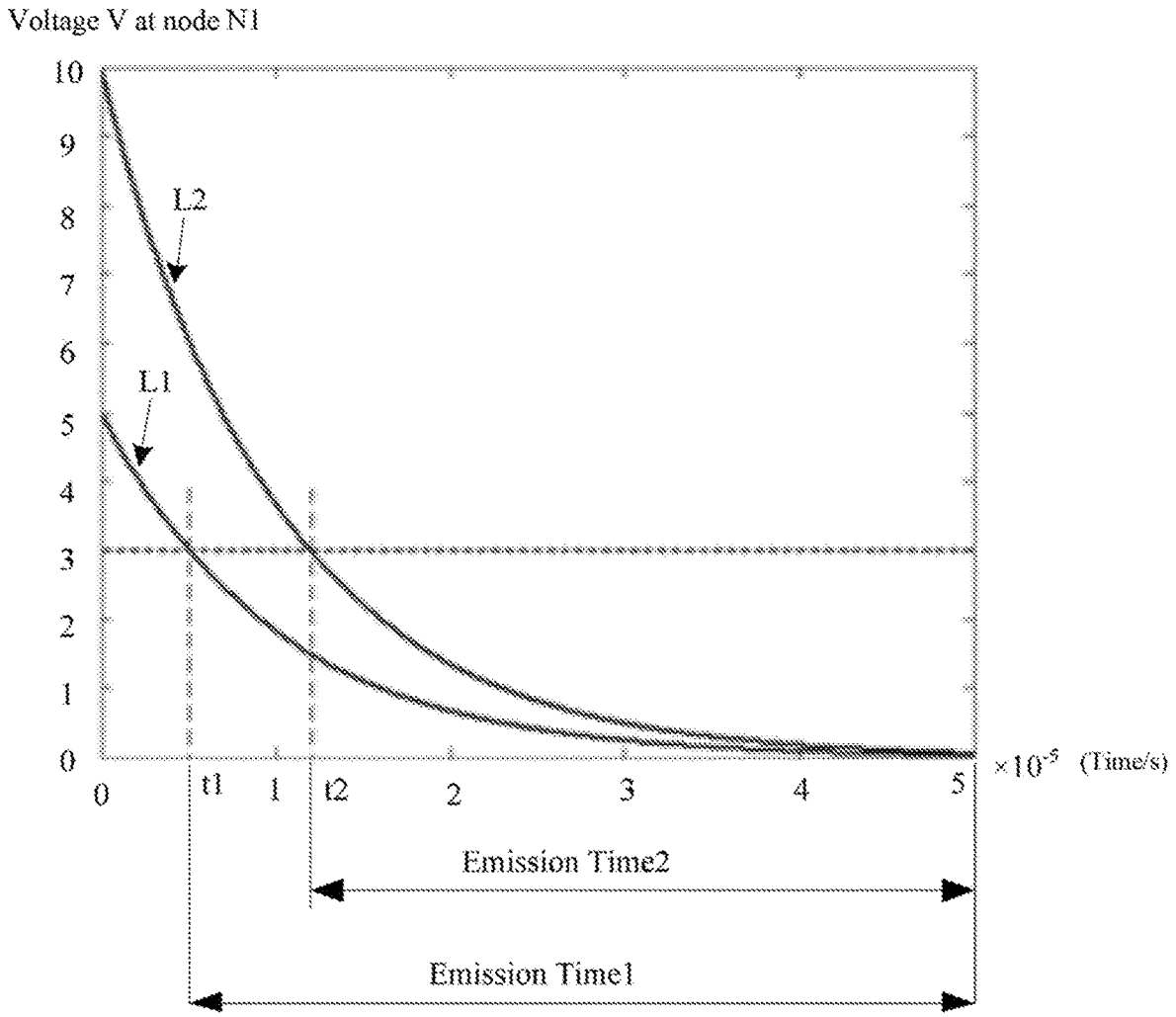
FIG. 5 is a graph showing a voltage value at node N1 changing with time according to a specific embodiment of the present disclosure.

For example, as shown in FIG. 5, when the voltage $V_{dataT}$ of the second data signal DataT is 5V, a corresponding discharging curve (i.e., a curve of the voltage value Vet) at node N1 changing with time) may be L1, and when the voltage $V_{dataT}$ of the second data signal DataT is 10V, a corresponding discharging curve may be L2. Assuming that the voltage value Vet) at node N1 decreases to 3V, the drive transistor M7 starts to turn on, then on-time of the drive transistor M7 corresponding to the discharging curve L1 is t1, a emission time of the Micro-LED D1 is Emission Time1, on-time of drive transistor M7 corresponding to the discharging curve L2 is t2, and a emission time of the Micro-LED D1 is Emission Time2. The on-time t1 of the drive transistor M7 corresponding to the discharging curve L1 is ahead of the on-time t2 of the drive transistor M7 corresponding to the discharging curve L2, and the emission time of Emission Time1 is longer than the emission time of Emission Time2 of the Micro-LED D1.

Therefore, when the voltage $V_{dataT}$ of the second data signal DataT changes, the time required for the voltage value V(t) at the node N1 to decrease to the turn-on voltage V1 will change accordingly, and the emission time of the Micro-LED D1 will also change accordingly.

Therefore, in an embodiment of the present disclosure, a pulse width control method may be used to control the emission time of the Micro-LED D1. Specifically, by changing the electric energy stored in the second capacitor C2 when the second capacitor C2 is charged by the second data signal DataT through the voltage value of the second data signal DataT, the rate of discharging the first discharging sub-circuit 120 by the second capacitor C2 is changed, thus the time required for the voltage value Vet) at the node N1 to decrease to the turn-on voltage V1 is changed, thereby the emission time of the Micro-LED D1 is changed.

It should be noted that within one frame, the emission time and luminance of the Micro-LED D1 are linearly related, so different emission time may cause the Micro-LED D1 to produce different luminance, that is, produce different gray scales. Therefore, in the embodiment of the present disclosure, the emission time of the Micro-LED D1 may be accurately and effectively controlled by adopting the pulse width control method, thereby accurately and effectively controlling the luminance and gray scales of the Micro-LED D1.

Figure 6:
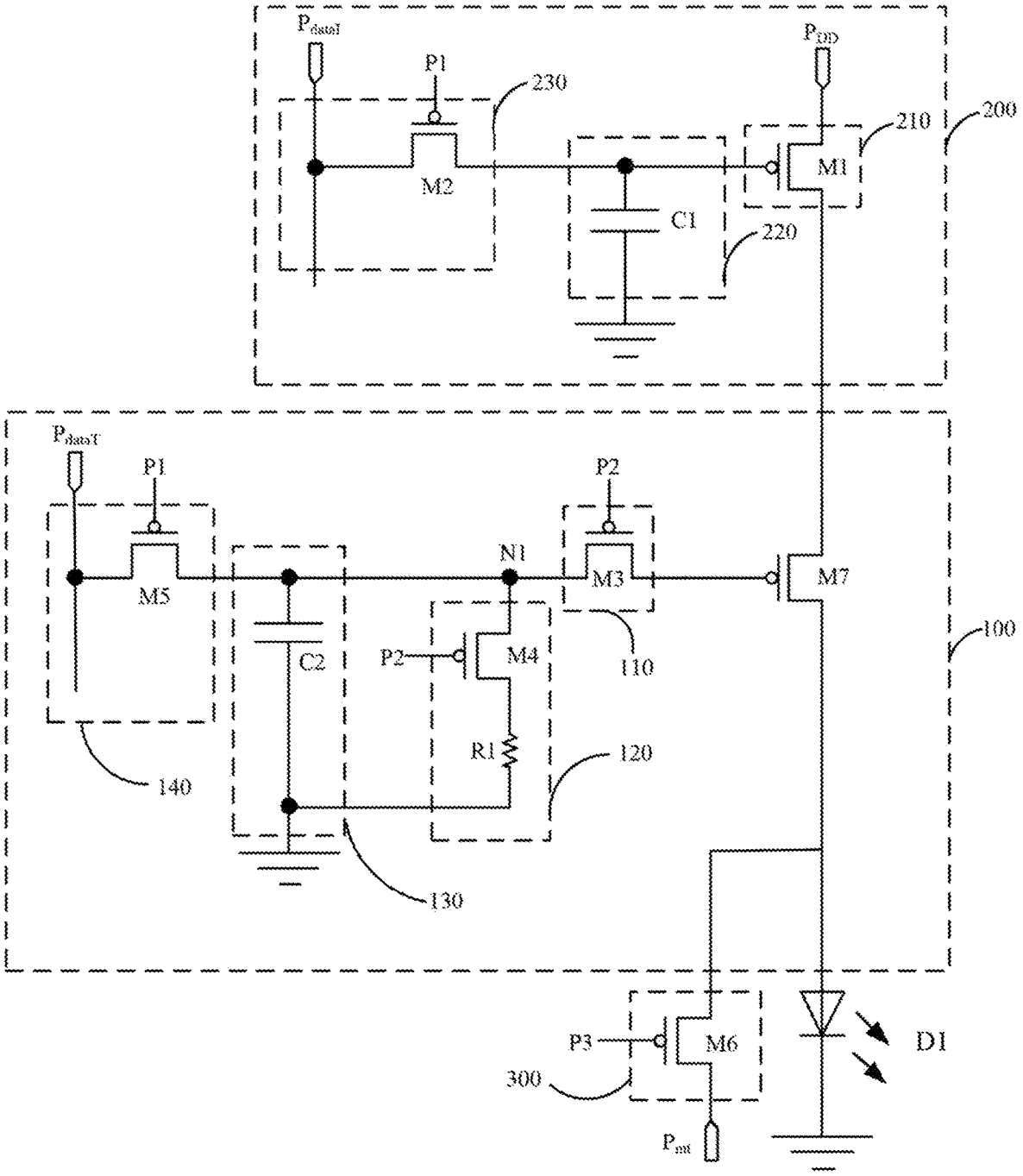
FIG. 6 is a schematic diagram of structure of a pixel drive circuit according to another embodiment of the present disclosure.

According to an embodiment of the present disclosure, as shown in FIG. 6, the pixel drive circuit may further include a reset circuit 300. The reset circuit 300 is connected with the anode of the Micro-LED D1, and is used for resetting the anode voltage of the Micro-LED D1 to a preset initial voltage.

According to an embodiment of the present disclosure, as shown in FIG. 6, the reset circuit 300 may include a sixth transistor M6. A first terminal of the sixth transistor M6 is connected with the anode of the Micro-LED D1, a second terminal of the sixth transistor M6 is connected with the second power supply terminal Pint, and a control electrode of the sixth transistor M6 is connected with a third scanning signal terminal P3, herein the reset signal Rst may be input to the control electrode of the sixth transistor M6 through the third scanning signal terminal P3.

Specifically, in order to avoid an interference of wrong data to the control process of the Micro-LED D1, it is necessary to reset the Micro-LED D1 through the reset circuit 300 before controlling the Micro-LED D1. In the embodiment, taking the sixth transistor M6 as a P-type transistor for example, of course, the sixth transistor M6 may be an N-type transistor. Specifically, a low-level signal may be input to the control electrode (gate) of the sixth transistor M6 in the reset circuit 300, that is, the reset signal Rst is set to a low level to turn on the sixth transistor M6, and control the first to fifth transistors and the drive transistor to turn off. At this time, the second power supply Vint input through the second power supply terminal Pint may be directly applied to the anode of the Micro-LED D1 to reset the anode voltage of the Micro-LED D1 to the preset initial voltage. As the preset initial voltage is a smaller voltage value, a voltage difference between two terminals of the Micro-LED D1 is smaller than the turn-on voltage, and the Micro-LED D1 does not emit light.

Figure 7:
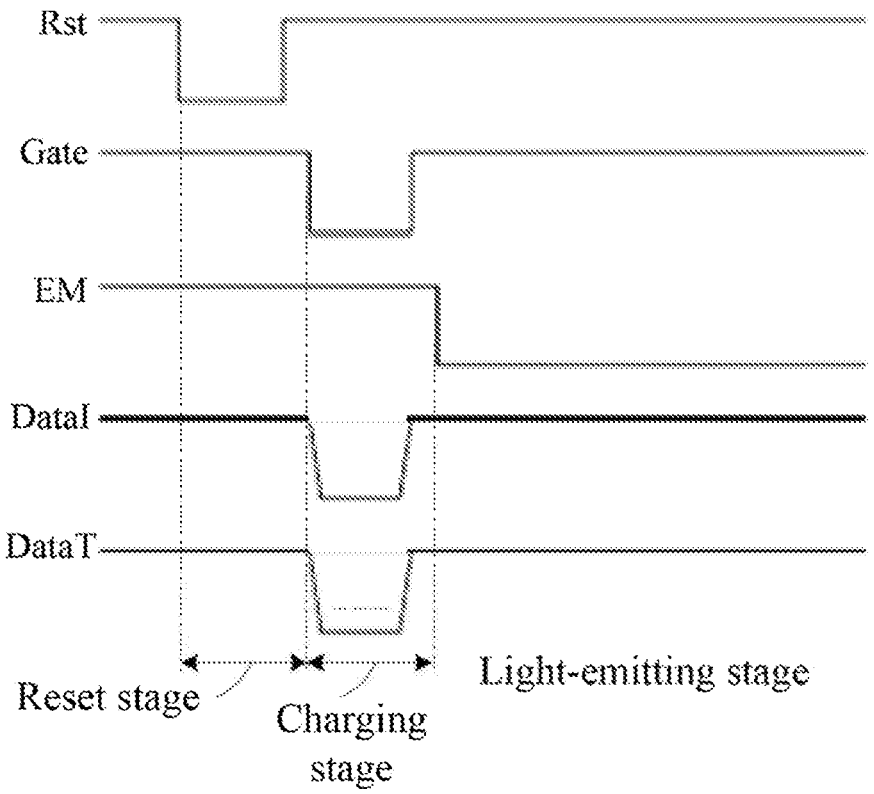
FIG. 7 is a timing diagram of a reset signal Rst, a gate signal Gate, a light emission signal EM, a first data signal DataI and a second data signal DataT within one frame according to an embodiment of the present disclosure.

According to a specific embodiment of the present disclosure, in the process of controlling the Micro-LED D1 through the pixel drive circuit shown in FIG. 6, the control process may be generally divided into three stages, namely, a reset stage, a charging stage and a light-emitting stage. A timing diagram of the reset signal Rst, the gate signal Gate, the light emission signal EM, the first data signal DataI and the second data signal DataT in each stage may be as shown in FIG. 7.

Figure 8:
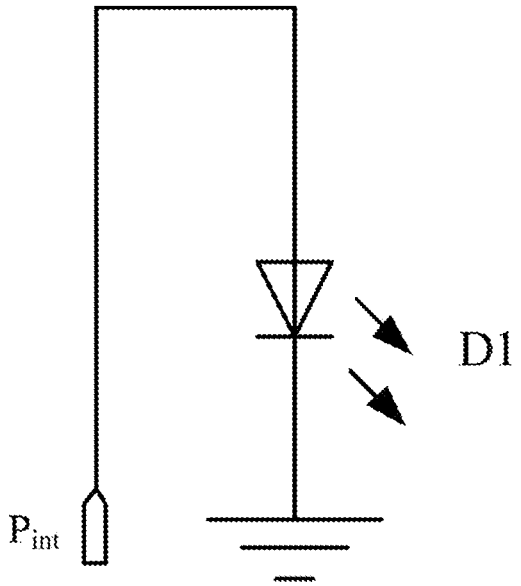
FIG. 8 is an equivalent circuit diagram of a pixel drive circuit in a reset stage according to a specific embodiment of the present disclosure.

Specifically, in the reset stage, a low-level signal may be input to the control electrode of the sixth transistor M6 in the reset circuit 300, that is, the reset signal Rst is set to a low level to turn on the sixth transistor M6, and control the first to fifth transistors and the drive transistor to turn off. At this time, the pixel drive circuit shown in FIG. 6 can be equivalent to a circuit diagram shown in FIG. 8, in which the second power supply Vint input through the second power supply terminal Pint is directly applied to the anode of the Micro-LED D1 to reset the voltage of the anode of the Micro-LED D1 to the preset initial voltage.

Figure 9:
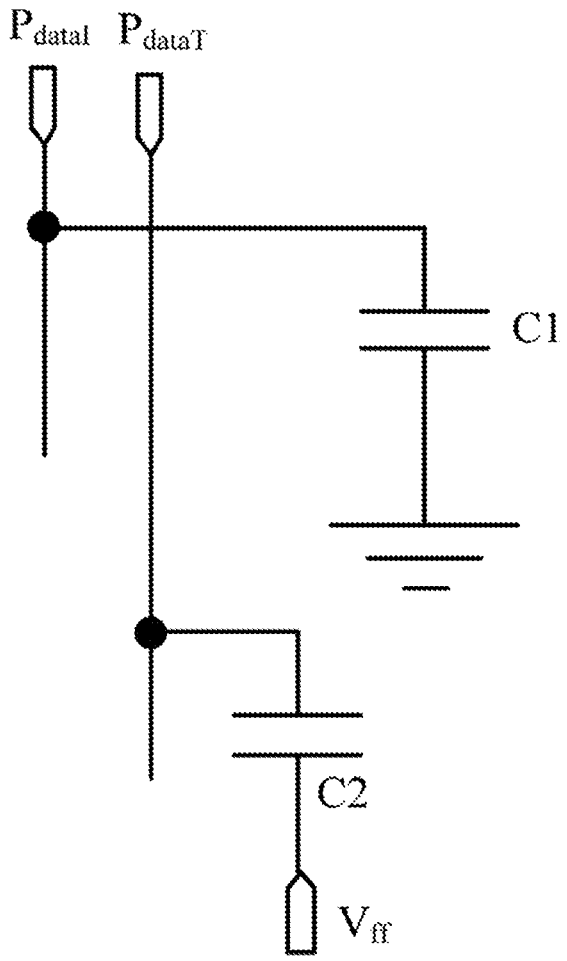
FIG. 9 is an equivalent circuit diagram of a pixel drive circuit in a charging stage according to a specific embodiment of the present disclosure.

Further, in the charging stage, a low-level signal may be input to the second transistor M2 in the first charging sub-circuit 230 and the fifth transistor M5 in the second charging sub-circuit 140, i.e., the gate signal Gate is set to a low level to turn on the second transistor M2 and the fifth transistor M5, a high-level signal is input to the control electrode of the sixth transistor M6 in the reset circuit 300, i.e., the reset signal Rst is set to a high level to turn off the sixth transistor M6, and a high-level signal is input to the control electrodes of the third transistor M3 in the second control sub-circuit 110 and the fourth transistor M4 in the first discharge sub-circuit 120, that is, the light emission signal EM is set to a high level to turn off the third transistor M3 and the fourth transistor M4. At this time, the pixel drive circuit shown in FIG. 6 can be equivalent to a circuit diagram shown in FIG. 9, in which the first capacitor C1 may be charged by the first data signal DataI input from the first data signal terminal $P_{DataI}$, and the second capacitor C2 may be charged by the second data signal DataT input from the second data signal terminal $P_{DataT}$. When input voltage $V_{dataI}$ of the first data signal DataI is different, energy stored in first second capacitor C1 is different. Similarly, when input voltage $V_{dataT}$ of the second data signal DataT is different, energy stored in the second capacitor C2 is also different.

Figure 10:
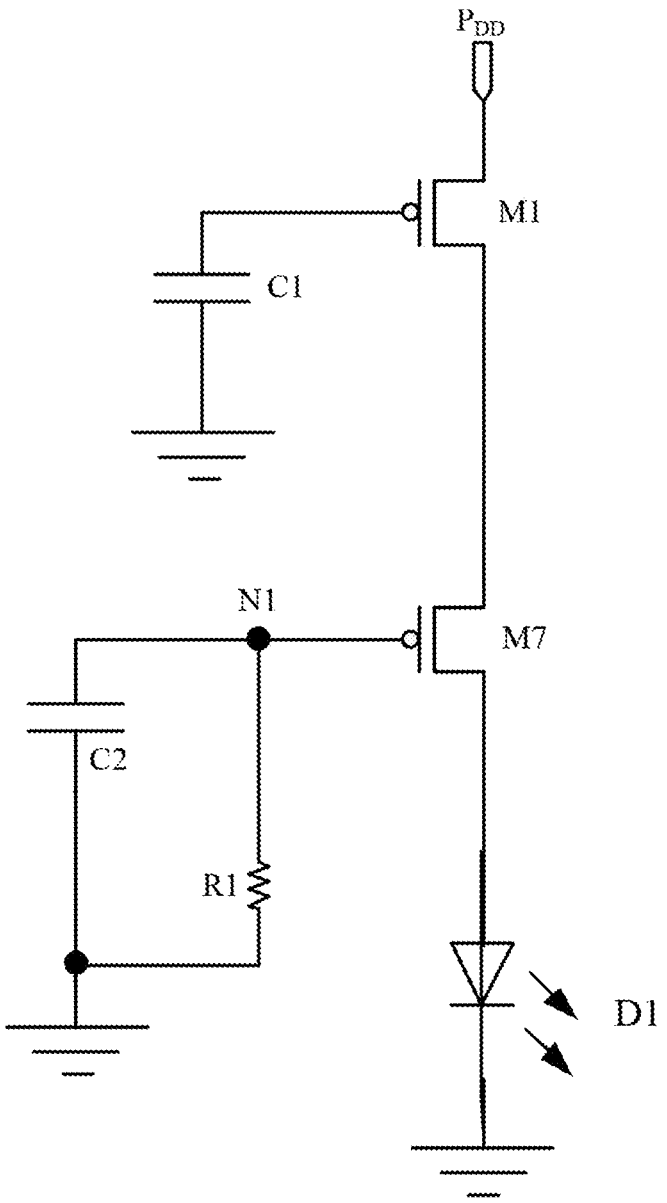
FIG. 10 is an equivalent circuit diagram of a pixel drive circuit in a light-emitting stage according to a specific embodiment of the present disclosure.

Furthermore, in the light-emitting stage, a high-level signal may be input to the second transistor M2 in the first charging sub-circuit 230 and the fifth transistor M5 in the second charging sub-circuit 140, i.e., the gate signal Gate is set to a high level to turn off the second transistor M2 and the fifth transistor M5, a high-level signal may be input to the control electrode of the sixth transistor M6 in the reset circuit 300, i.e., the reset signal Rst is set to a high level to turn off the sixth transistor M6, and a low-level signal is input to the control electrodes of the third transistor M3 in the second control sub-circuit 110 and the fourth transistor M4 in the first discharging circuit 120, i.e., to set the light emission signal EM to a low level, so that the third transistor M3 and the fourth transistor M4 are turned on. At this time, the pixel drive circuit shown in FIG. 6 can be equivalent to a circuit diagram shown in FIG. 10, in which the gate voltage for driving the first transistor M1 can be controlled by the first capacitor C1, so that the first transistor M1 works at a specified current. At the same time, electric energy stored in the second capacitor C2 is discharged through the first discharging sub-circuit 120 in which the resistor R1 is located. When the voltage at the node N1 decreases to the turn-on voltage of the drive transistor M7, the drive transistor M7 turns on, and the Micro-LED D1 starts to emit light and always works in the high EQE region until an end of the current frame.

It should be noted that when the Micro-LED D1 starts to emit light, the pulse width control method can also be adopted to control an emission time of the Micro-LED D1. A specific control process may be referred to the above embodiments, and will not be described in detail herein for brevity.

Therefore, the pixel drive circuit according to the embodiment of the present disclosure can make a Micro-LED always work in a high-efficiency region, and improve working stability of the Micro-LED. By controlling an emission time of the Micro-LED, luminance and gray scales of the Micro-LED are controlled, and problems caused by driving the Micro-LED through an AM drive mode are effectively solved.

To sum up, according to the pixel drive circuit of the embodiment of the present disclosure, an emission time of a Micro-LED is controlled by the light emitting control circuit, and a preset current is output to the light emitting control circuit by the current control circuit to control the Micro-LED to work under a set current density, and luminous efficiency of the Micro-LED under the set current density is greater than a set threshold. Therefore, not only can the Micro-LED be controlled to work in a high current density region all the time, thus ensuring the luminous efficiency of the Micro-LED and improving working stability of the Micro-LED, but also can the emission time of the Micro-LED be accurately and effectively controlled, thus the luminance and gray scales of the Micro-LED are controlled, and the user experience are greatly improved.

Figure 11:
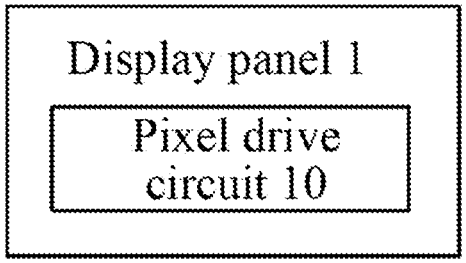
FIG. 11 is a block diagram of a display panel according to an embodiment of the present disclosure.

In addition, an embodiment of the present disclosure further proposes a display panel. As shown in FIG. 11, the display panel 1 of the embodiment of the present disclosure may include the pixel drive circuit 10 in the above embodiments.

According to the display panel of the embodiment of the present disclosure, through the pixel drive circuit above, not only can the Micro-LED be controlled to always work in a high current density region, which ensures the luminous efficiency of the Micro-LED, thereby improving the working stability of the Micro-LED, but also can the emission time of the Micro-LED be accurately and effectively controlled, thereby controlling the luminance and gray scales of the Micro-LED and greatly improving user experience.

It should be understood that various parts of the present disclosure may be implemented in hardware, software, firmware, or a combination thereof. In the above implementations, multiple acts or methods may be implemented through software or firmware stored in a memory and executed by a suitable instruction execution system. For example, if the multiple acts or methods are implemented through hardware as same as those in another implementation, any one or a combination of the following technologies known in the art may be adopted: a discrete logic circuit having logic gates for implementing logic functions on data signals, an application-specific integrated circuit having appropriate combinational logic gates, a programmable gate array (PGA), a field programmable gate array (FPGA), etc.

In the description of the present disclosure, an orientation or position relationship indicated by the terms "center", "longitudinal", "transverse", "length", "width", "thickness", "on", "below", "front", "rear", "left", "right", "vertical", "horizontal", "top", "bottom", "inner", "outer", "clockwise", "counterclockwise", "axial", "radial", "circumferential" and the like is based on the orientation or position relationship shown in the drawings. It is only for the convenience of describing the present disclosure and simplifying the description, but is not intended to indicate or imply that the device or element referred to must have the specific orientation, be constructed and operated in the specific orientation, and thus it cannot be interpreted as a limitation on the present application.

In addition, the terms "first" and "second" are used for description purposes only, and cannot be interpreted as indicating or implying relative importance or implicitly indicating a number of technical features referred to. Thus, the features defined with "first" and "second" may include at least one of the features explicitly or implicitly. In the description of the present disclosure, "a plurality of" refers to at least two, for example, two or three, unless specified otherwise.

In the present disclosure, unless otherwise clearly specified and defined, the terms "install", "connect", "link", "fix" and other terms should be broadly interpreted. For example, it may be connected fixedly or connected detachably, or integrated; it may be a mechanical connection or an electrical connection; it may be directly connected, or may be indirectly connected through an intermediary, it may be an internal connection between two elements or an interaction between two elements, unless otherwise clearly specified. For those of ordinary skill in the art, the specific meanings of the above terms in the present disclosure may be understood according to a specific situation.

In the present disclosure, unless otherwise clearly specified and defined, that a first feature is "on" or "under" a second feature may be that the first and second features are in direct contact, or the first and second features are in indirect contact through an intermediary. Moreover, that the first feature is "over", "above" and "on" the second feature may be that the first feature is directly above or obliquely above the second feature, or simply means that a horizontal height of the first feature is higher than that of the second feature. That the first feature is "below", "beneath" and "under" the second feature may be that the first feature is directly below or obliquely below the second feature, or simply means that the horizontal height of the first feature is less than that of the second feature.

In the description of the specification, reference terms "an embodiment", "some embodiments", "an example", "a specific example", or "some examples" refers that a particular feature, structure, material, or characteristic described in connection with the embodiment or example is included in at least one embodiment or example of the present disclosure. In the specification, the schematic representation of the above-mentioned terms is not necessarily directed to the same embodiment or example. Moreover, the specific feature, structure, material, or characteristic described may be combined in any one or more embodiments or examples in a proper way. In addition, those skilled in the art may incorporate and combine different embodiments or examples and features of different embodiments or examples described in the specification if there is no conflict.

Although embodiments of present disclosure have been shown and described above, it should be understood that above embodiments are just explanatory, and cannot be construed to limit the present application. For those skilled in the art, changes, amendments, alternatives, and modifications may be made to the embodiments without departing from the scope of the present disclosure.

We claim:

1. A pixel drive circuit, comprising:

a micro light-emitting diode, a cathode of the micro light-emitting diode being grounded;

a light-emitting control circuit, connected with a anode of the micro light-emitting diode, and configured to control an emission time of the micro light-emitting diode; and a current control circuit, connected with the light-emitting control circuit, and configured to output a preset current to the light-emitting control circuit to control the micro light-emitting diode to work under a set current density, wherein luminous efficiency of the micro light-emitting diode under the set current density is greater than a set threshold, wherein the current control circuit comprises:

a first control sub-circuit, a first terminal of the first control sub-circuit being connected with a first power supply terminal, and a second terminal of the first control sub-circuit being connected with the light-emitting control circuit;

a first storage sub-circuit, connected with a third terminal of the first control sub-circuit, and configured to discharge through the first control sub-circuit and control the first control sub-circuit to work at the preset current; and a first charging sub-circuit, connected with the first storage sub-circuit, and configured to charge the first storage sub-circuit.

2. The pixel drive circuit according to claim 1, wherein the first control sub-circuit comprises:

a first transistor, a first electrode of the first transistor being connected with the first power supply terminal, and a second electrode of the first transistor being connected with the light-emitting control circuit;

the first storage sub-circuit comprises:

a first capacitor, a first terminal of the first capacitor being connected with a control electrode of the first transistor, and a second terminal of the first capacitor being grounded;

the first charging sub-circuit comprises:

a second transistor, a first electrode of the second transistor being connected with the first terminal of the first capacitor, a second electrode of the second transistor being connected with a first data signal terminal, and a control electrode of the second transistor being connected with a first scanning signal terminal.

3. The pixel drive circuit according to claim 2, wherein the light-emitting control circuit is configured to:

control the emission time of the micro light-emitting diode by adopting a pulse width control method.

4. The pixel drive circuit according to claim 3, wherein the first transistor, the second transistor, the third transistor, the fourth transistor, the fifth transistor, the sixth transistor and the drive transistor are all P-type transistors.

5. The pixel drive circuit according to claim 3, wherein the light-emitting control circuit comprises:

a drive transistor, a first electrode of the drive transistor being connected with the current control circuit, and a second electrode of the drive transistor being connected with the anode of the micro light-emitting diode;

a second control sub-circuit, a first terminal of the second control sub-circuit being connected with a control electrode of the drive transistor;

a first discharging sub-circuit, connected with a second terminal of the second control sub-circuit;

a second storage sub-circuit, the second storage sub-circuit is connected with the second terminal of the first control sub-circuit, and configured to output a gradually decreased voltage and control the drive transistor to turn on when the voltage is lower than a set threshold; and a second charging sub-circuit, connected with the second storage sub-circuit, and configured to charge the second storage sub-circuit.

6. The pixel drive circuit according to claim 5, wherein the second control sub-circuit comprises:

a third transistor, a first electrode of the third transistor being connected with the control electrode of the drive transistor, and a control electrode of the third transistor being connected with a second scanning signal terminal;

the first discharging sub-circuit comprises:

a fourth transistor, a first electrode of the fourth transistor being connected with a second electrode of the third transistor, and a control electrode of the fourth transistor being connected with the second scanning signal terminal; and a resistor, a first terminal of the resistor being connected with a second electrode of the fourth transistor, and a second terminal of the resistor being grounded;

the second storage sub-circuit comprises:

a second capacitor, a first terminal of the second capacitor being connected with the second terminal of the resistor, and a second terminal of the second capacitor being connected with the second electrode of the third transistor;

the second charging sub-circuit comprises:

a fifth transistor, a first electrode of the fifth transistor being connected with the second terminal of the second capacitor, a second electrode of the fifth transistor being connected with a second data signal terminal, and a control electrode of the fifth transistor being connected with the first scan signal terminal.

7. The pixel drive circuit according to claim 6, further comprising:

a reset circuit, connected with the anode of the micro light-emitting diode, and configured to reset a voltage of the anode of the micro light-emitting diode to a preset initial voltage.

8. The pixel drive circuit according to claim 7, wherein the reset circuit comprises:

a sixth transistor, a first electrode of the sixth transistor being connected with the anode of the micro light-emitting diode, a second electrode of the sixth transistor being connected with a second power supply terminal, and a control electrode of the sixth transistor being connected with a third scanning signal terminal.

9. The pixel drive circuit according to claim 2, wherein the first transistor, the second transistor, the third transistor, the fourth transistor, the fifth transistor, the sixth transistor and the drive transistor are all P-type transistors.

10. A display panel, comprising: the pixel drive circuit of claim 1.

* * * * *